US006626342B1

(12) United States Patent
Gleason

(10) Patent No.: US 6,626,342 B1
(45) Date of Patent: Sep. 30, 2003

(54) BACKPACK HAVING A MODULAR FRAME

(76) Inventor: Dana W. Gleason, 409 Olive St., Bozeman, MT (US) 59715

( * ) Notice: Subject to any disclaimer, the term of this patent is extended or adjusted under 35 U.S.C. 154(b) by 0 days.

(21) Appl. No.: 09/589,928

(22) Filed: Jun. 7, 2000

Related U.S. Application Data

(60) Provisional application No. 60/137,865, filed on Jun. 7, 1999.

(51) Int. Cl.[7] ..... A45F 3/08

(52) U.S. Cl. ..... 224/633; 224/633; 224/652

(58) Field of Search ..... 224/633, 634, 224/637, 644, 652, 628, 630, 635

(56) References Cited

U.S. PATENT DOCUMENTS

| | | | | |
|---|---|---|---|---|
| 4,479,595 | A | 10/1984 | Opsal | 224/211 |
| 4,982,884 | A | 1/1991 | Wise | 224/211 |
| 5,005,744 | A | 4/1991 | Gleason | 224/211 |
| 5,090,526 | A | 2/1992 | Jacober | 190/107 |
| 5,131,576 | A | 7/1992 | Turnipseed | 224/262 |
| 5,181,638 | A | 1/1993 | McHale | 224/215 |
| 5,240,159 | A | 8/1993 | Gregory | 224/209 |
| 5,341,974 | A | 8/1994 | Robinson et al. | 224/215 |
| 5,361,955 | A | 11/1994 | Gregory | 224/211 |
| 5,366,126 | A | 11/1994 | Dausien | 224/211 |
| 5,487,498 | A | 1/1996 | Gleason | 224/224 |
| 5,529,230 | A | 6/1996 | Smith | 224/625 |
| 5,553,759 | A | 9/1996 | McMaster et al. | 224/631 |
| 5,564,612 | A | 10/1996 | Gregory | 224/633 |
| 5,577,648 | A | 11/1996 | Sason et al. | 224/637 |
| 5,632,429 | A | 5/1997 | Cantwell | 224/630 |
| 5,704,530 | A | 1/1998 | Scherer | 224/632 |
| 5,725,139 | A | 3/1998 | Smith | 224/637 |
| 5,730,347 | A | 3/1998 | Finot | 224/631 |
| 5,732,867 | A | 3/1998 | Perkins et al. | 224/628 |
| 5,762,243 | A | 6/1998 | McMaster et al. | 224/262 |
| 5,762,251 | A | 6/1998 | Gleason | 224/635 |
| 5,806,741 | A | 9/1998 | Kirk | 224/634 |
| 5,836,489 | A | 11/1998 | Swetish | 224/262 |
| 5,868,292 | A | 2/1999 | Stephens et al. | 224/161 |
| 5,890,640 | A | 4/1999 | Thompson | 224/630 |
| 5,904,282 | A | 5/1999 | Gleason | 224/635 |
| 5,954,253 | A | 9/1999 | Swetish | 224/631 |
| 5,971,244 | A | 10/1999 | Jaeger | 224/632 |
| 6,024,265 | A | 2/2000 | Clements | 224/630 |

*Primary Examiner*—Nathan J. Newhouse
(74) *Attorney, Agent, or Firm*—Shook, Hardy & Bacon LLP

(57) ABSTRACT

The present invention provides for a backpack having a pack bag and a modular pack frame. The modular pack frame includes a generally flexible frame sheet that is fixed to a rigid support bar at the center of the frame that is contoured to mimic the shape of a user's backbone. The frame sheet is similarly curved and adapts to fit the remainder of the user's back. A pad overlies the sheet and extends throughout the pack frame. Reinforcement members are positioned in the pack frame and pack bag to prevent distortion of the pack frame and to concentrate the load of the pack toward the lumbar region and comfortably distribute the remainder of the load to the user's shoulders, hips, and other portions of the back.

30 Claims, 4 Drawing Sheets

BACKPACK HAVING A MODULAR FRAME

CROSS-REFERENCE TO RELATED APPLICATIONS

This application claims the benefit of U.S. Provisional Application No. 60/137,865, filed Jun. 7, 1999.

STATEMENT REGARDING FEDERALLY SPONSORED RESEARCH OR DEVELOPMENT

Not Applicable.

BACKGROUND OF THE INVENTION

The present invention relates to a backpack. More specifically, the present invention relates to a backpack having a modular pack frame formed from a flexible contoured material that distributes the load of the backpack comfortably to the user's body. The pack frame does not become distorted when loaded due to the reinforcements in the backpack and the manner in which the pack frame and pack bag are attached to one another.

Backpacks, and particularly backpacks capable of holding contents having a large volume or weight, typically include rigid, tubular frames that support the weight of the pack bag. These frames are secured to the user's body at a pair of shoulder straps and a hip belt that act together to maintain the frame at a small distance from the back of the user. The downward load of the backpack is only felt at the user's shoulders and at the hip belt since the frame does not contact the user's back. While frames of this type provide a great deal of support for the contents of the bag, they are often uncomfortable and unwieldy. Also, the backpack's contents tend to cause the pack bag to sag with the load being focused near the small of the user's back on the hip belt and not at the desired position at the outer lumbar region of the user's back near the outside of the user's hips. A number of attempts have been made to properly transfer the load created by a rigid frame backpack. One particularly device is the flexible harness system disclosed in U.S. Pat. No. 5,762,251 to Gleason.

Another solution to the problem of ineffective load distribution has been to incorporate "soft" frame sheets within the pack bag. These frames are made from flexible material contoured to the shape of the user's body. Typically, the frame sheets are manufactured from an aluminum or molded plastic sheet and are placed within the panel of the backpack that contacts the user's back. The frames of these internal frame backpacks are typically more flexible than conventional external frames and more evenly distribute the load of the backpack across the user's back. However, the flexible frames of internal backpacks are typically even less effective than rigid external backs at properly distributing the load to the hips and outer lumbar region of the user.

Also, in prior art backpacks having internal frames, the frame sheet tends to become distorted from its original shape under the weight of the backpack's load. Specifically, the frame sheet tends to become cylindrical in shape as the sides of the frame are pulled toward one another by the forces created by the weight of the backpack's contents. When this occurs, the distorted frame sheet causes weight to be unevenly distributed across the user's back and the backpack becomes increasingly uncomfortable. Further, the backpack is unstable and tends to pivot on the user's back since the load is applied centrally instead of at balanced points on either side of the user's body. Since internal frame backpacks typically do not properly distribute the backpack's load and the frame sheet has a tendency to become distorted, "soft" internal frame backpacks are generally ineffective for transporting large loads. Another disadvantage of internal frame backpacks is that the shape of the pack bag is dictated largely by the shape of the frame. Accordingly, internal frame backpacks do not effectively store contents that could otherwise be retained in the backpack.

In order to overcome these and other disadvantages, a backpack with a flexible pack frame that will concentrate the load of the backpack at the user's hips and shoulders while comfortably fitting the user's back is needed. Also, a flexible "soft" frame backpack that can support heavy loads while retaining its original shape is needed. Further, a comfortable backpack is needed that can retain a greater variety and amount of items. Moreover, a backpack is needed that will stabilize the load created by the backpack's contents on the user's body.

SUMMARY OF THE INVENTION

It is an object of the present invention to provide a backpack that properly distributes the load of the pack bag to the back, shoulders and hips of the user.

A further object of the present invention is to provide a backpack having a modular pack frame that does not become distorted by the forces created by the loaded backpack.

Still another object of the invention is provide a backpack that applies a stabilized load to the user's body.

Another object of the invention is to provide a backpack with a flexible frame having additional storage spaces.

Accordingly, the present invention provides for a backpack having a pack bag and a modular pack frame. The modular pack frame includes a generally flexible frame sheet that is fixed to a rigid support bar at the center of the frame that is contoured to mimic the shape of a user's backbone. The frame sheet is similarly curved and adapts to fit the remainder of the user's back. A pad overlies the sheet and extends throughout the pack frame. A plurality of other reinforcement members are positioned in the pack frame and pack bag that prevent distortion of the pack frame and help to comfortably distribute the load to the user's shoulders, hips, and back.

The modular pack frame is attached to the pack bag at a number of points so as to prevent the frame from becoming distorted. First, the pack frame is secured to the top of the pack bag by a pair of straps originating along the top of the shoulder pads. Second, a rod, positioned in generally axial alignment with the support bar, is coupled at either end by opposing bearings on the pack frame and telescoped within a sleeve located adjacent the rigid support bar of the pack frame. Further, the modular pack frame is connected to the pack bag by a pair of straps at the upper left and right portions of the pack frame and pack bag at a position proximate the flat portion of the user's shoulders. The straps are releasably fastened to the opposing straps on the pack bag at mating male and female buckle members. Additionally, the modular pack frame is secured to hip belts flaps on the pack bag by patches of VELCRO® fasteners at the lower right and left side flaps of the pack frame. The pack bag and pack frame are also attached at a centrally located bottom flap. The weight of the backpack's contents and the tension created by a hip belt of the backpack cause a concentrated, compression load at the area where the hip belt connects to the pack frame. Accordingly, this load is transmitted to the pad of the pack frame and the load is safely and comfortably transferred to the user's body.

Moreover, since the pack frame and hip belt envelopes the user's body without substantially altering the generally flat rear panel of the pack bag, open storage spaces are formed between the outer edges of the pack bag and pack frame.

Additional objects, advantages and novel features of the invention will be set forth, in part, in a description which follows, and in part, will become apparent to those skilled in the art upon examination of the following, or may be learned by practice of the invention.

BRIEF DESCRIPTION OF THE DRAWINGS

In the accompanying drawings which form a part of this specification and are to be read in conjunction therewith. Like reference numerals are used to indicate like parts in the various views.

Figure 1:
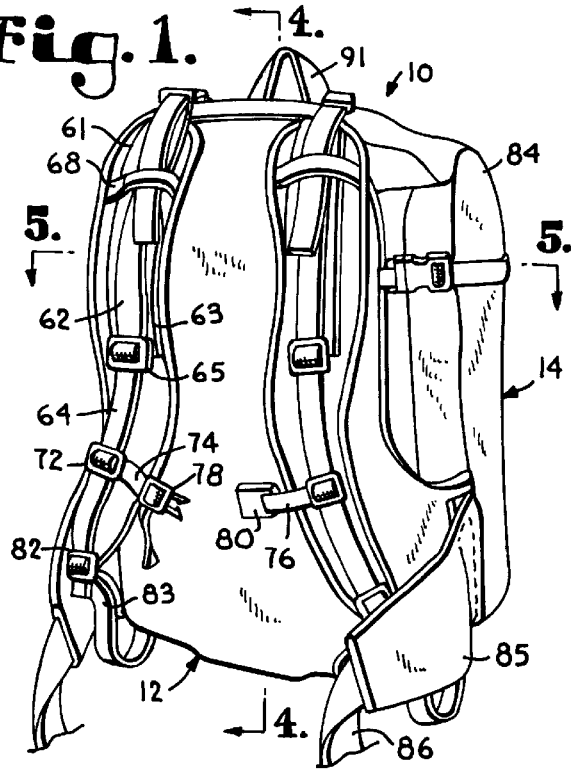
FIG. 1 is a front perspective view of a backpack according to the present invention.
Figure 2:
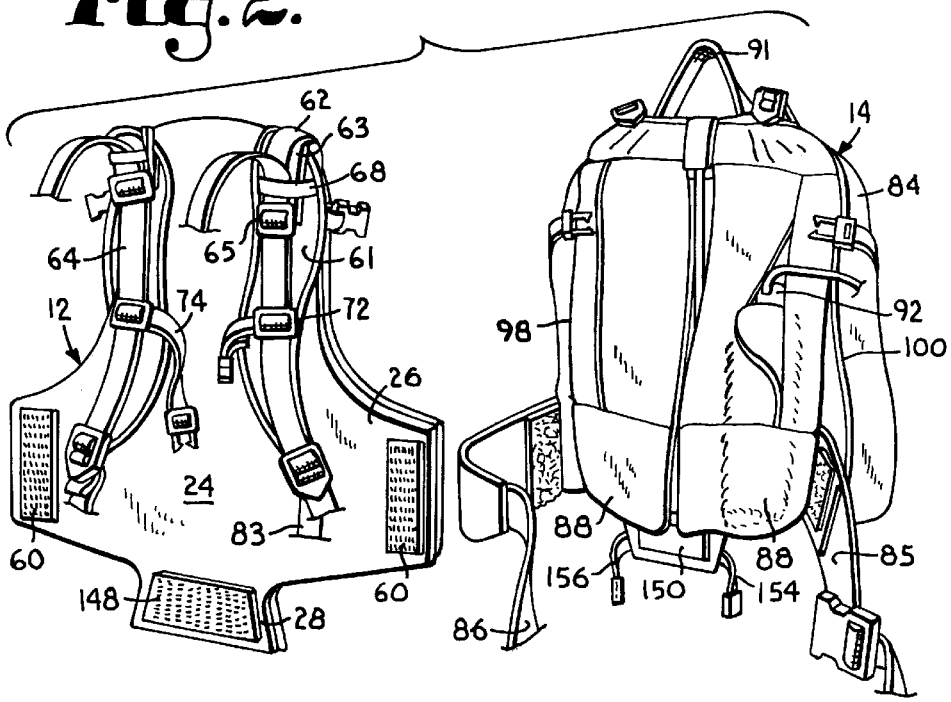
FIG. 2 is an exploded, perspective view of the backpack accordingly to the present invention with the modular pack frame detached from the pack bag.

Referring to the drawings in greater detail, and initially FIGS. 1 and 2, a backpack designated generally by the numeral 10 is shown. Backpack 10 has a modular pack frame 12 and pack bag 14.

The distinct, modular pack frame 12 of the present invention is shown detached from pack bag 14 in FIG. 2. With additional reference to FIGS. 3 and 4, pack frame 12 has an outer shell 20 defining a thin cavity 22 for housing the structural components of the pack frame 12. The shell 20 is preferably produced from two sheets of material sewn to one another at a seam 21. Shell 20 has a main section 24 that is generally rectangular, a pair of side flaps 26 formed at the lower edges of main section 24, and a bottom flap 28 extending centrally from main section 24. The corners of bottom flap 28 are preferably formed at acute angles, and the flap is about ¾ inch wider at the comers than at the base. Preferably, the shell is made of nylon or a similarly strong synthetic material, but may also be made from cloth, leather or other materials known in the art. Alternatively, the shell 20 may be formed from a laminated, synthetic material and molded into a unitary structure.

Figure 3:
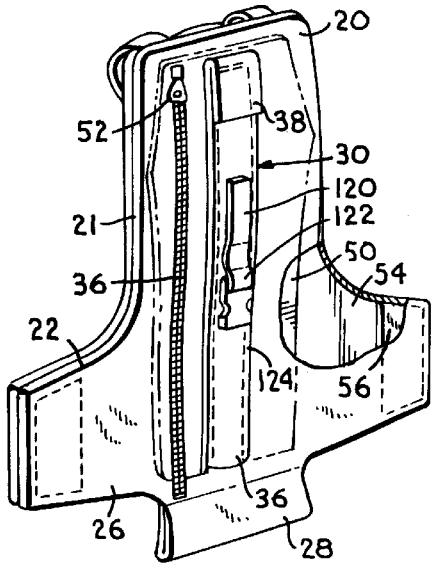
FIG. 3 is a rear, perspective view of the modular pack frame according to the present invention.
Figure 4:
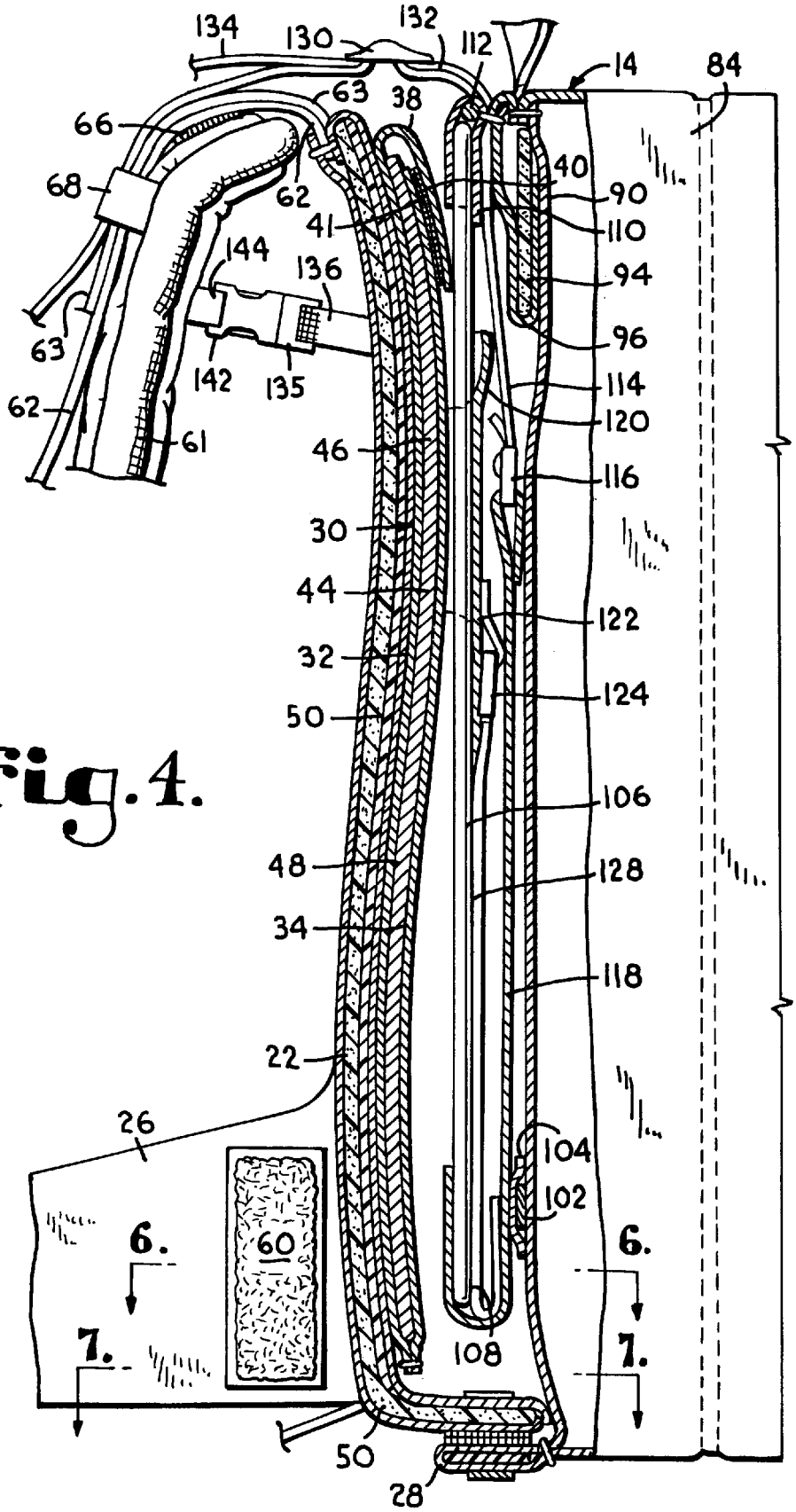
FIG. 4 is a sectional view of the backpack taken along line 4—4 of FIG. 1.
Figure 5:
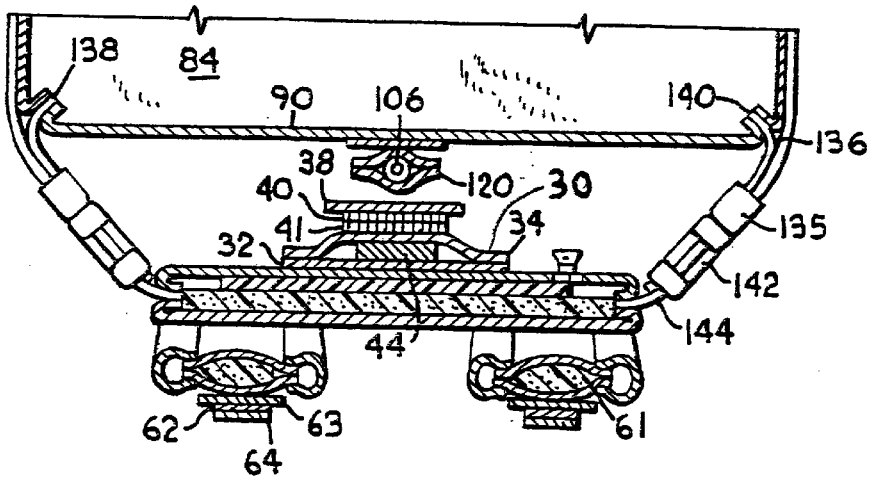
FIG. 5 is a sectional view of the backpack taken along line 5—5 of FIG. 1.
Figure 6:
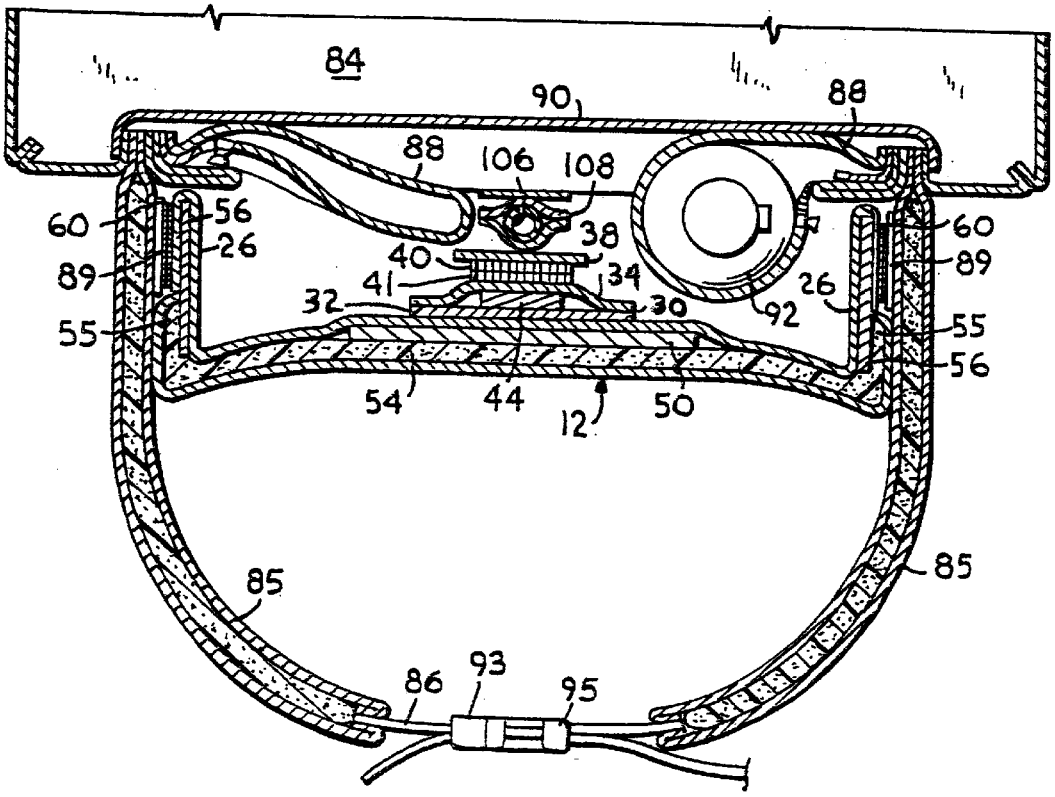
FIG. 6 is a sectional view of the backpack taken along line 6—6 of FIG. 4.

On the side of pack frame 12 facing the pack bag 14, an elongated sleeve 30 is positioned on the exterior of shell 20 at the center of pack frame 12. As shown in FIGS. 5 and 6, sleeve 30 is formed by a pair of strips 32 and 34 sewn to shell 20 at the edges of the strips. The strips are preferably made from a strong, flexible material such as nylon. The elongated sleeve 30 terminates at a closed end 36 near the bottom of main section 24. At the top of elongated sleeve 30, the interior strip 32 includes a flap 38 extending beyond exterior strip 34. With reference to FIGS. 3 and 4, flap 38 may be folded over and secured to exterior strap 34 by complementary VELCRO® fasteners 40 and 41 located on flap 38 and exterior strap 34 respectively. A rigid support bar 44 is housed within sleeve 30. As best shown in FIG. 4, support bar 44 includes a concave region 46 and a convex region 48 and is generally shaped to complement the typical curve of the spinal cord of the user. While the support bar 44 is removably placed within sleeve 30 in the preferred embodiment, the support bar 44 could be formed integrally and permanently within the shell 20.

Support bar 44 provides support for a frame section 50 placed within cavity 22. Frame section 50 is made of a thin sheet of flexible material such as plastic. The frame section 50 is placed within cavity 22 through a slit 36 that may be closed by a zipper 52. The frame section 50 is centered within cavity 22 and sewn to shell 20 along the edges of strips 32 and 34 that form the elongated sleeve 30. The curvilinear shape of support bar 44 similarly contours the frame section 50 to mimic to the shape of the user's back. Alternatively, the frame section 50 may be manufactured in the desired contoured shape to maintain the back mimicking shape independently or in combination with support bar 44. Preferably, strips 32 and 34 and frame section 50 are sewn to the shell 20 simultaneously during the manufacturing process. Alternatively, the frame section 50 may be sewn to the shell 20 separately or may be secured by welding, adhesives, or other methods of fastening known in the art.

As best shown in FIG. 3, frame section 50 is slightly tapered from its widest point to either end. On the side of the pack frame 12 that contacts the user's back, a pad 54 is placed between the frame section 50 and the shell 20. Pad 54 is generally constructed from a flexible padding material such as foam rubber and has a significantly greater thickness than frame section 50. The pad 54 extends beyond frame section 50 and throughout most of the cavity 22 defined by shell 20. However, as shown in FIG. 6, pad 54 does not extend completely within side flaps 26 of the pack frame 12 and terminates about two inches before reaching the outer edges of side flaps 26.

With reference to FIGS. 3 and 6, a stiffening panel 56 is secured within each side flap 26. The stiffening panels 56 are preferably made from a plastic material having some degree of rigidity. The stiffening panels 56 are roughly the height of the side flaps 26 and extend to the outer edges of the side flaps 26. The stiffening panels 56 overlap with the outer edges of the pad 54 in each side flap by about one inch. The stiffening panels 56 are sewn into place along the perimeter of VELCRO® fastening patches 60, discussed in detail below, placed on each side flap 26. The portion 55 of pad 54 overlapping each stiffening panel 56 is positioned between the panel 56 and the interior of pack frame 12. The stitching that holds the fastening patches 60 and stiffening panels 56 in the proper position also acts as a lateral support for the portion of pad 54 within each side flap 26.

The shoulder pads 61 are coupled to the pack frame 12 at the upper right and left sides of pack frame 12. With reference to FIGS. 2 and 4, each shoulder pad 61 is secured to the pack frame 12 by a pair of attachment straps 62 and 63 sewn to the pack frame 12. An anchoring strap 64 originates on each shoulder pad 61 near a buckle 65, and attachment straps 62 and 63 are secured to the anchoring strap 64 near the position at which the anchoring strap 64 is fixed to the shoulder pad 61. In the preferred embodiment, attachment strap 63 is sewn to attachment strap 62 on either side of strap 63 to form a small loop (not shown) that is placed around a fastening ring (not shown) underlying the buckle 65. Alternatively, a single attachment strap may be used to connect each shoulder pad 61 to the pack frame 12 and various other means may be employed to connect the attachment straps to both the pack frame 12 and the shoulder pads 61.

Preferably, the smaller attachment strap 62 is threaded through an intermediate buckle 72 at a position between the pack bag 12 and the shoulder straps 61. As described below, the intermediate buckle 72 also receives a pack bag connection strap 134. The underside of the attachment strap 63 includes VELCRO® fasteners 66 that prevent the attachment straps from sliding on shoulder pads 61. Also, elastic bands 68 on the shoulder pads 61 also maintain attachment strap 62 and 63 in proximity with the shoulder pads 61.

Each anchoring strap 64 extends through a buckle 65 and is sewn to the lower end of each shoulder pad 61. Between buckle 65 and the lower end of shoulder pad 61, an intermediate buckle 72 is placed on the anchoring strap 64. At intermediate buckles 72, transversely extending straps 74 and 76 are mounted one the anchoring strap 64 and directed toward on another. In the preferred embodiment, the straps 74 and 76 are connected to one another by an adjustable male buckle member 78 and side releasable female buckle member 80 when the shoulder pads 61 are placed over the user's shoulders. When the buckling members 78 and 80 are fastened to one another, the end of strap 74 is pulled through adjustable male buckle 78 and the shoulder pads 61 are directed toward one another.

A pair of shoulder pad straps 83 are coupled to the pack frame 12 at the lower right and left portions of the pack frame 12, and are secured to the shoulder pads 61 at adjustment buckles 82 held at the end of anchoring straps 64. The shoulder pad straps 83 can be pulled or released through adjustment buckles 82 to either tighten or loosen the shoulder pads 61.

The pack bag 14 includes a main compartment 84, hip belt flaps 85, and an adjustable hip belt 86. The main compartment includes an opening (not shown) that may be secured by a zipper or other fastening means. As best shown in FIG. 6, the hip belt flaps 85 correspond to the shape of side flaps 26 of pack frame 12 and include VELCRO® fastening patches 89 that match the fastening patches 60 of the pack frame 12. Hip belt 86 is made of a flexible strip of material. The opposing straps of hip belt 86 are secured to one another by an adjustable male buckle 93 and an adjustable female buckle 95.

With continued reference to FIG. 6, the pack bag 14 of the present invention also includes a pair of pouches 88 positioned near the outer edges of the 8 rear panel 90. The pouches 88 are ideal for holding water bottles 92 or other gear and may include zippers or other fastening means for securing contents within the pouches. The bag 14 may further include a number of sub-compartments, pockets, flaps, and partitions as known in the art. As shown in FIG. 1, a loop 91 positioned at the top of the pack bag 14 may be used to handle or hang the pack bag 14 when the backpack 10 is not positioned on the user's back.

As shown in FIG. 4, the pack bag 14 of the present invention includes a rectangular pad 94 secured to the upper portion of rear panel 90. The pad 94 is preferably made from a sheet of plastic foam. A pouch 96 firmly holds the pad 94 between the lower fold of pouch 96 and the upper edge of the rear panel 90. The pad 94 extends the width of the rear panel 90 so that either end of the pad 94 abuts the opposing side sections 98 and 100 of the pack bag 14. (FIG. 2) Preferably, the pad 94 extends downwardly a distance of about 3 to 4 inches from the top of rear panel 90.

Also, the pack bag 14 has an elongated, lower stay 102 extending across the width of the bag 14. The stay 102 is preferably formed from a fiberglass bar but may be constructed from other materials such as wood or light metals. The stay 102 FIG. 4 is encased within an attached bag 104 that extends across pack bag 14 and terminates at the side walls 98 and 100 (FIG. 2) at roughly the same height on the pack bag 14 as the top of hip belt flaps 85.

The pack frame 12 is secured to the pack bag 14 by corresponding structures positioned at a number of locations on pack frame 12. As shown in FIGS 4–6, the pack frame 12 and pack bag 14 are secured to one another by a rigid rod 106 coupled to pack bag 14 along the center line of the shell 20 of the pack frame 12 and rear panel 90 of the pack bag 14. Preferably, the rigid rod 106 is cylindrical and formed from fiberglass. As best shown in FIG. 4, rod 106 is held by opposing bearings 108 and 110 on the pack bag 14. Lower bearing 108 is secured to the stay holding bag 104 and the upper bearing 110 is secured to a brace 112 held by a strap 114 sewn to the top of rear panel 90. As shown in FIG. 4, lower bearing 108 is secured to the outer side of bag 104. Additionally, the bearing may be secured to rear panel 90 underneath stay 102. The bearings 108 and 110 are preferably formed from nylon webs that encase cylindrical plastic caps. The nylon portion of each bearing allows the bearing to be sewn to the pack bag 12 and the plastic cap prevents the rod 106 from puncturing or otherwise causing the bearing to fail. Strap 114 along rod 106 is threaded through an adjustment buckle 116 at the end of a second strap 118 attached to pack bag 14 near lower bearing 108. Strap 114 may be tightened by pulling the excess of the strap 118 through adjustment buckle 116 to create tension in straps 114 and 118. When the straps 114 and 118 are in tension, the rod 106 is firmly held within opposing bearings 108 and 110.

Rod 106 of pack bag 14 is secured to pack frame 12 at a sleeve 120 positioned adjacent the elongated bag 30. To place the rod 106 of the pack bag 14 within the sleeve 120 on pack frame 12, strap 112 is loosened to allow an end of the rod 106 to be removed from one of the bearings 108 or 110. The free end of the rod 106 is telescoped through sleeve 120 and placed within the appropriate bearing 108 or 110. Then, strap 114 is pulled taut to maintain rod 106 in the proper position.

A small strap 122 extends from sleeve 120 and is directed toward the bottom of the pack frame 12. A female attachment buckle 124 located at the end of strap 122 is releasably coupled to a corresponding male buckle not shown at the end of a strap 128 extending from stay holding bag 104 at a position between strap 118 and lower bearing 108. When rod 106 is placed within sleeve 120, straps 122 and 128 may be buckled together to prevent the pack bag 14 from sliding relative to pack frame 12. The length of rod 106 is dictated by the size of the pack bag 14. Depending on the size of the pack bag 14, rod 106 varies in length from approximate 18 to 22 inches. The pack frame 14 may be attached to bags of various size since the length of the rod 106 is not dependent on the size of the pack frame 14.

Figure 8:
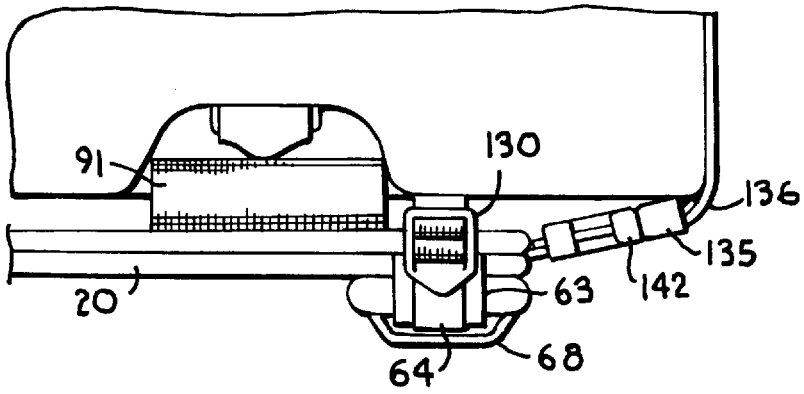
FIG. 8 is a partial plan view of the backpack of the present invention.

As best shown in FIGS. 4 and 8, the pack bag 14 is also connected to the pack frame 12 at a pair of adjustment buckles 130 positioned at the end of a pair of short straps 132 secured to the top of pack bag 14 on either side of loop 91. Connection straps 134 are coupled to the shoulder pads 61 near buckle 65 and are received within the adjustment buckles 130 on the pack bag 14. Each strap 134 is threaded through buckle 67, overlays attachment strap 63, and is placed under the elastic band 68 before reaching the appropriate left and right adjustment buckles 130.

The pack bag 14 is also releasably secured to the pack frame 12 at a position on the frame that is proximate the flat region of the user's clavicle when the backpack 10 is placed over the user's shoulders. In the preferred embodiment, a pair of slidable male buckling members 135 are positioned on a bag compression strap 136 secured to the left side of the rear panel 90 at a first end 138 and to the right side of the rear panel 90 at a second end 140. The male buckling members 135 are releasably secured within mating female buckling members 142 coupled to the a pain straps of 44 originating at the outer edges of the pack frame shell 20. It has been found that the desired position to mount straps 144 on the pack frame 12 is between 12 and 14 inches, and generally about 13 inches, from the bottom of the side flaps 26. This position allows the pack frame to fit more than 90 percent of the population of users.

The length of bag compression strap 136 is adjustable, and is preferably shortened to create a compression fit about the contents of the pack bag 14 to prevent the contents of the bag from sliding within the main compartment 84 and to minimize bulging or other undesirable effects that may occur due to the relative positioning of the objects within main compartment 84 and the sidewalls of the compartment. To vary the effective length of the bag compression strap 136, an adjustment buckle (not shown) or other means capable of reducing the effective length is placed on bag compression strap 136 between the first and seconds ends of the strap. Additionally, the bag compression strap 136 may support a bag compression panel or additional storage structure on the front of pack bag 14.

The pack frame 12 is also attached to the pack bag 14 at rectangular VELCRO® fastening patches 60 and corresponding VELCRO® fastening patches 89 of VELCRO® material on hip belt flaps 85. Alternatively, other quick release fasteners including mechanical and woven fasteners may be used instead of the VELCRO® patches. As best shown in FIG. 6, side flaps 26 and the stiffening panels 56 positioned within side flaps 26 are bent rearwardly with respect the remainder of the pack frame 12, and the fastening patches 148 of the hip belt 86 are aligned with corresponding fastening patches 60 on the pack frame 12.

Figure 7:
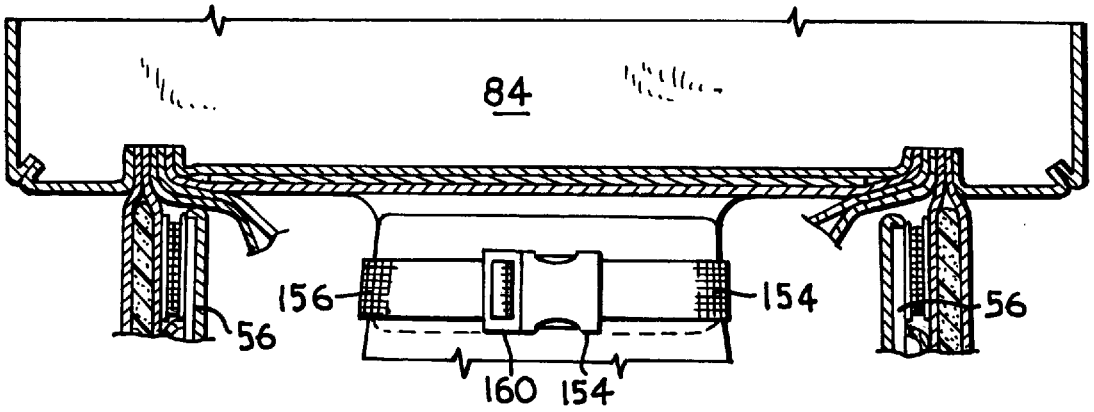
FIG. 7 is a sectional view of the backpack taken along line 7—7 of FIG. 4.

The pack frame 12 is also fastened to the pack bag 14 at bottom flap 28. A VELCRO® fastening patch 148 sewn to the flap 28 is aligned with a corresponding VELCRO® patch 150 positioned on a flap 152 by bending the flaps toward one another. As shown in FIGS. 2 and 7, once the two patches 148 and 150 are fastened to one another, a loop comprised of opposing straps 154 and 156 surround flaps 28 and 152. The straps 154 and 156 are secured to the side of flap 152 opposite VELCRO® patch 150. Preferably, straps 154 and 156 are fastened to one another by a side release female buckle 158 at the end of strap 154 that receives male buckle 160 at the end of strap 156. The straps lock the opposing VELCRO® patches 148 and 150 in connection with one another by engaging the flared side walls of flap 28 and matching flap 152 and creating an interference fit.

In operation,the pack frame 12 is fastened to the pack bag 14 at the various positions described above. The main compartment 84 is loaded and securely closed by the zipper (not shown). The user then puts on the backpack 10 by putting his arms through the holes defined by attachment straps 62 and 63, shoulder pads 61, and adjustment straps 83. Next, the user secures the hip belt flap 85 and hip belt 86 around his waist by forcing the male buckling member 93 into engagement with matching female buckle 95 and pulling the excess portion of the belt through the adjustable portion of male buckle 93 and/or female buckle 95.

Due to the downward force of the contents of the bag and the tension created by hip belt 86, the lower stay 102 of the pack bag 14 is forced toward the user's back. Meanwhile, the flat shape of rear panel 90 of bag 14 is generally maintained by the combination of stay 102, rod 106 and, to a lesser extent, pad 94. With reference to FIG. 6, the hip belt flaps 85 wrap around the user's outer lumbar region and hips. The side flaps 26 are directed inwardly at a relatively normal angle from the remainder of pack frame 12. The load of pack bag 12 creates a concentrated, compressive force at the stiffening panels 56 within the side flaps 26. The load in the stiffening panels 56 is transferred to the outer, lower edges of pad 54 of pack frame 12. The pad 54 distributes the load to the outer lumbar region and hips of the user. Meanwhile, the portion of the load transferred to the user's back is generally equally distributed by the frame section 50 to the adjacent pad 54. Also, the flexible pad 54 and frame section 50 allow the user to twist and bend without creating awkward or uncomfortable load transfer to the user's back. More importantly, the increased load on either hip stabilizes and grips the backpack on the user's body. Thus, the pack is both more comfortable and safe than those taught in the prior art.

Also, the manner in which the load is distributed and the positions at which the pack frame 12 and pack bag 14 are attached to one another prevent the cylindrical deformation typical with internal, soft frame packs. The attachment of the external pack frame 12 to the pack bag 14 and the reinforcement members in either structure prevent the deformation of the pack frame 12 to overcome the problems in the prior art. Specifically, the connections located near the flat portions of the user's shoulders and hips prevent the pack bag 14 from pulling at the edges of pack frame 12. The side flaps 26 and attached hip belt flaps 85 wrap around the user's body to define spaces at the outer edges of the pack bag 14 and pack frame 12. Within this space, items such as water bottle 92 may be stored in pouches 96 that are formed on the interior of bag 14. Thus, the backpack 10 is capable of storing more items than traditional packs. Further, the items stored in these spaces are protected from the elements by the pack frame 12 and pack bag 14, but are not compressed by the components of the backpack 10.

Thus, the backpack 10 of the present invention provides a simple, effective device that overcomes the problems associated with rigid, external frame and flexible, internal frame backpacks. The modular pack frame 12 does not become distorted during loading and comfortably and safely transmits the weight of the backpack to the user's body.

From the foregoing, it will be seen that this invention is one well adapted to attain all the ends and objects hereinabove set forth together with other advantages which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

I claim:

1. A backpack for a user to hold and transport articles, the backpack comprising:

a frame having a frame section with opposing sides, the frame section conforming to the shape of the user's back;

a bag coupled with the frame, the bag having a back panel with a pair of opposing sides and at least one horizontal support located between the sides of the back panel for maintaining the shape of the back panel; and the frame further compriseing a pair of stiffening panels extending from the opposing sides of the frame section, each stiffening panel coupled between the frame section and one of the sides of the back panel of the bag whereby a portion of the load of the bag is transferred through the stiffening panels to the frame section.

2. The backpack of claim 1 wherein the frame further comprises a pair of flaps that extend from the sides of the frame section, and wherein the stiffening panels are secured to the flaps, whereby the frame envelops the lumbar region of the user's back so that the portion of the load transferred through the stiffening panels is directed across the lumbar region of the user's back.

3. The backpack of claim 2 wherein the frame further comprises a pad, a portion of the pad disposed within the flaps.

4. The backpack of claim 1 wherein the horizontal support comprises a stay.

5. The backpack of claim 1 wherein the bag includes a top and wherein the horizontal support comprises a generally rectangular pad located proximate the top of the bag.

6. The backpack of claim 5 wherein said generally rectangular pad is housed within a pouch extending from the top of the bag.

7. A backpack for a user to hold and transport articles, the backpack comprising:

a frame having a frame section with opposing sides, the frame section conforming to the shape of the user's back;

a bag coupled with the frame, the bag having a back panel with a pair of opposing sides and at least one horizontal support located between the sides of the back panel for maintaining the shape of the back panel and at least one vertical support;

the frame further compriseing a sleeve, the sleeve located centrally between and generally parallel to the opposing sides of the back panel of the bag; and wherein the vertical support comprises a rod slidingly received within the sleeve and coupled with the bag at both ends of the rod.

8. The backpack of claim 7 wherein the bag further comprises a pair of bearings sized for receipt of the rod, the bearings positioned at a distance from one another to hold the rod in compression between the bearings.

9. A backpack for a user to hold and transport articles, the backpack comprising:

a frame having a top, a bottom and a pair of opposing sides, the frame including a frame section disposed between the opposing sides, the frame section having sufficient flexibility to permit the frame to conform to the shape of the user's back, the frame further including a pair of flaps extending from the opposing sides of the frame section and a pair of stiffening panels, each stiffening panel secured to one of the flaps;

a bag having a compartment, a pair of opposing sides and a pair of opposing hip belt flaps extending from the sides of the bag, each hip belt flap coupled to one of the flaps of the frame, wherein a portion of the weight of the bag is transferred through the stiffening panels and is concentrated at the lumbar area of the user's back at the hip belt flaps coupled to the flaps of the frame.

10. The backpack of claim 9 wherein the frame section is made from a plastic material.

11. The backpack of claim 9 wherein the hip belt flaps include two layers coupled together by opposing patches of hook and loop fastening materials, the first layer coupled with the frame and the second layer coupled with the bag.

12. The backpack of claim 9 wherein the backpack further comprises a pair of shoulder pads attached to the top of the frame, and wherein the bag has a top and a pair of attachment straps extending from the top, the attachment straps of the bag removably coupled with the shoulder pads of the frame.

13. The backpack of claim 9 wherein the frame further comprises a pair of straps extending from the sides of the main section at a position proximate the clavicle of the user when the frame is placed on the user, and wherein the bag further comprises a pair of attachment straps coupled to the sides of the bag, each attachment strap releasably secured to the straps of the frame.

14. The backpack of claim 9 wherein the frame further comprises a bottom flap extending from the bottom of the frame, and wherein the bag has a bottom flap corresponding to the bottom flap of the frame wherein the bottom flap of the frame and the bottom flap of the bag are coupled to one another.

15. The backpack of claim 9 wherein the bag further comprises a pair of hip belt straps coupled with the the hip belt flaps for encircling the waist of the user wherein the frame is held against the user when the hip belt straps are secured to one another around the user's waist.

16. The backpack of claim 15 wherein the frame further comprises a pad positioned proximate the frame section, the pad disposed between the frame section and the user when the frame is placed on the user, the pad extending throughout the frame including a portion of the flaps of the frame wherein the pad conforms to fit around the user's lumbar area when the backpack is placed on the user and the hip belt straps are secured around the user's waist.

17. The backpack of claim 16 wherein the pad is made from a foam rubber material.

18. The backpack of claim 9 wherein the frame further comprises a bar shaped complementary to the user's spine, the bar disposed centrally between the sides of the frame.

19. The backpack of claim 18 wherein the frame section is fixedly secured to the bar wherein the bar imparts a curved shape to the frame section.

20. The backpack of claim 19 wherein the frame further comprises a fabric shell encasing the frame section.

21. The backpack of claim 20 wherein the frame further comprises an elongated bag sewn to the fabric shell wherein the bar is housed within the bag.

22. The backpack of claim 9 wherein the backpack further comprises at least one horizontal support.

23. The backpack of claim 22 wherein the horizontal support comprises a stay extending between the sides the stay coupled with the bag proximate the hip belt flaps.

24. The backpack of claim 22 wherein the bag further comprises a rear panel and wherein the horizontal support comprises a generally rectangular pad secured to the rear panel near the top of the bag and extending substantially between the sides of the bag.

25. The backpack of claim 24 wherein said generally rectangular pad is housed within a pouch extending from the top of the bag.

26. The backpack of claim 9 further comprising at least one vertical support.

27. The backpack of claim 26 wherein the frame further comprises a sleeve, the sleeve located centrally between and generally parallel to the sides of the bag, and wherein the vertical support comprises a rod slidingly received within the sleeve and coupled with the bag at both ends of the rods.

28. The backpack of claim 27 wherein the bag further comprises a pair of bearings sized for receipt of the rod, the bearings positioned at a distance from one another to hold the rod in compression between the bearings.

29. A backpack for carrying items on a user's back, the backpack comprising:

a bag having opposing sides, means for conforming to the lumbar area of the user, the conforming means being coupled with the bag, and means for transferring the load from the sides of the bag to the conforming means, the transferring means including a pair of stiffening members coupled between the sides of the bag and the conforming means.

30. The backpack of claim 29 wherein the conforming means includes a frame section disposed near the center of the user's back when wearing the backpack and a pad overlapping the frame section, the pad having a portion extending beyond the frame section wherein the transferring means is coupled with the pad at the portion extending beyond the frame section.

* * * * *